US005601104A

United States Patent [19]

Perkins

[11] Patent Number: 5,601,104

[45] Date of Patent: Feb. 11, 1997

[54] AUTO TENT

[75] Inventor: Walter R. Perkins, Greenville, N.C.

[73] Assignee: The Hatteras Group, Greenville, N.C.

[21] Appl. No.: 589,591

[22] Filed: Jan. 22, 1996

[51] Int. Cl.[6] ..... E04H 15/06

[52] U.S. Cl. ..... 135/88.06; 135/88.03

[58] Field of Search ..... 135/88.05, 88.06, 135/88.01, 88.15, 88.13, 88.03, 96, 128, 137

[56] References Cited

U.S. PATENT DOCUMENTS

| | | | |
|---|---|---|---|
| 2,480,509 | 8/1949 | Ripley . | |
| 2,989,967 | 6/1961 | Lee | 135/88.06 X |
| 3,940,099 | 2/1976 | McCleskey | 135/88.06 X |
| 4,200,115 | 4/1980 | Parker | 135/88.05 |
| 4,640,332 | 2/1987 | Turner . | |
| 4,754,774 | 7/1988 | Leader . | |
| 4,944,321 | 7/1990 | Moyet-Ortiz | 135/88.06 |
| 5,158,103 | 10/1992 | Leu . | |
| 5,241,977 | 9/1993 | Flores et al. | 135/88.06 |

FOREIGN PATENT DOCUMENTS

| | | | |
|---|---|---|---|
| 0875992 | 8/1961 | United Kingdom | 135/88.06 |

*Primary Examiner*—Lanna Mai
*Attorney, Agent, or Firm*—Gipple & Hale

[57] ABSTRACT

A portable canopy is provided which is adapted to extend in an horizontal plane outward from the rear of a vehicle and which is supported and maintained in its erected position by the rear wheels of the vehicle. The canopy of the invention can be quickly disassembled or assembled and carried in a convenient package in the trunk or other storage facility of the vehicle and provides an easy-to-use stable awning for picnics or other events occurring proximate to the motor vehicle.

4 Claims, 3 Drawing Sheets

AUTO TENT

FIELD OF THE INVENTION

The present invention is directed to a portable canopy which is adapted to extend outward from the rear end of a vehicle and to be securely anchored in place during use by the rear wheels of the vehicle. The invention provides a portable awning or covering to shade and shelter from the elements during outdoor events such as "tailgate parties" or picnics.

BACKGROUND OF THE INVENTION

The increasing popularity of outdoor activity coupled with increasing use of automobiles and recreational type vehicles has led to an increasing demand and need for various types of shelter and facilities which can be easily transported in the vehicles to the recreation site and then easily set up and used proximate to the vehicle. One especially notable example of this phenomena has been the outgrowth of the traditional picnics associated with sports events such as horse races or football games. These events frequently occur in parking areas adjacent to the sports facility and consist essentially of dining and socializing prior to and during the event. The expression "tailgate party" has, of course, arisen from the fact that these events occur either at the rear end of a station wagon or pick up truck with its tailgate opened; or at the rear of a traditional sedan with the trunk open to accomodate the food and accoutrements for the party. Unfortunately, inclement weather as well as withering sun frequently occur; and the usual facilities provided near stadiums and races courses do not provide much shelter. Accordingly, participants in such "tailgate parties", when with faced with undesirable weather conditions must choose between abandoning the event or retreating to the cramped confines of their vehicle. Similar considerations apply to such activities as picnics which are held in the vicinity of the vehicle or in campground situations where the camping facilities are adjacent the campers' vehicle. It would therefore be highly desirable to have a portable awning or canopy which could be carried in disassembled condition in the trunk or other available space of a vehicle and easily assembled and erected to provide a temporary shelter adjacent the vehicle and, in fact, temporarily forming an extension of the vehicle.

Various structures and devices have long been known to provide shelter or covering in combination with a motor vehicle. In some instances, these structures have essentially been nothing more than tents designed to be erected adjacent the vehicle and in other cases they have been covers for the vehicle itself. In most instances, however, these structures have been of relatively complex design and not specifically designed to provide a rearward extension of the vehicle to function as a temporary shelter or awning.

Examples of prior art structures, are:

U.S. Pat. No. 2,480,509 to Ripley

U.S. Pat. No. 4,754,774 to Leader

U.S. Pat. No. 5,158,103 to Lew

U.S. Pat. No. 5,241,977 to Flores et al.

U.S. Pat. No. 4,640,332 to Turner

It is accordingly an object of the present invention to provide a portable, easy to erect, compact canopy or awning which can be quickly assembled and erected to provide a rearward facing cover which extends from the back of a motor vehicle and which is securely anchored in place by the rear wheels of that motor vehicle.

DETAILED DESCRIPTION OF THE INVENTION

The invention is a canopy or awning adapted to extend in a horizontal plane from an upright supporting structure which is anchored by the rear wheels of a motor vehicle such that the canopy extends away from the vehicle's rear to provide a covering or awning. The supporting structure is comprised of rigid tubular members which interlock so that they can be disassembled for easy storage and transportation. The awning or canopy itself is of a flexible material such as cloth or plastic that can be easily removed from the supporting structure and folded or rolled into a compact size for storage and transportation. The supporting structure is anchored by means of flat plates which rest on the underlying ground and are of sufficient dimension to allow the vehicle to be placed with its rear wheels on the plates so that the full rear weight of the vehicle anchors the canopy and maintains it in the desired upright configuration during use. The invention will however be more fully appreciated and comprehended by having reference to the drawings which illustrate a preferred embodiment thereof.

DETAILED DESCRIPTION OF A PREFERRED EMBODIMENT

Figure 1:
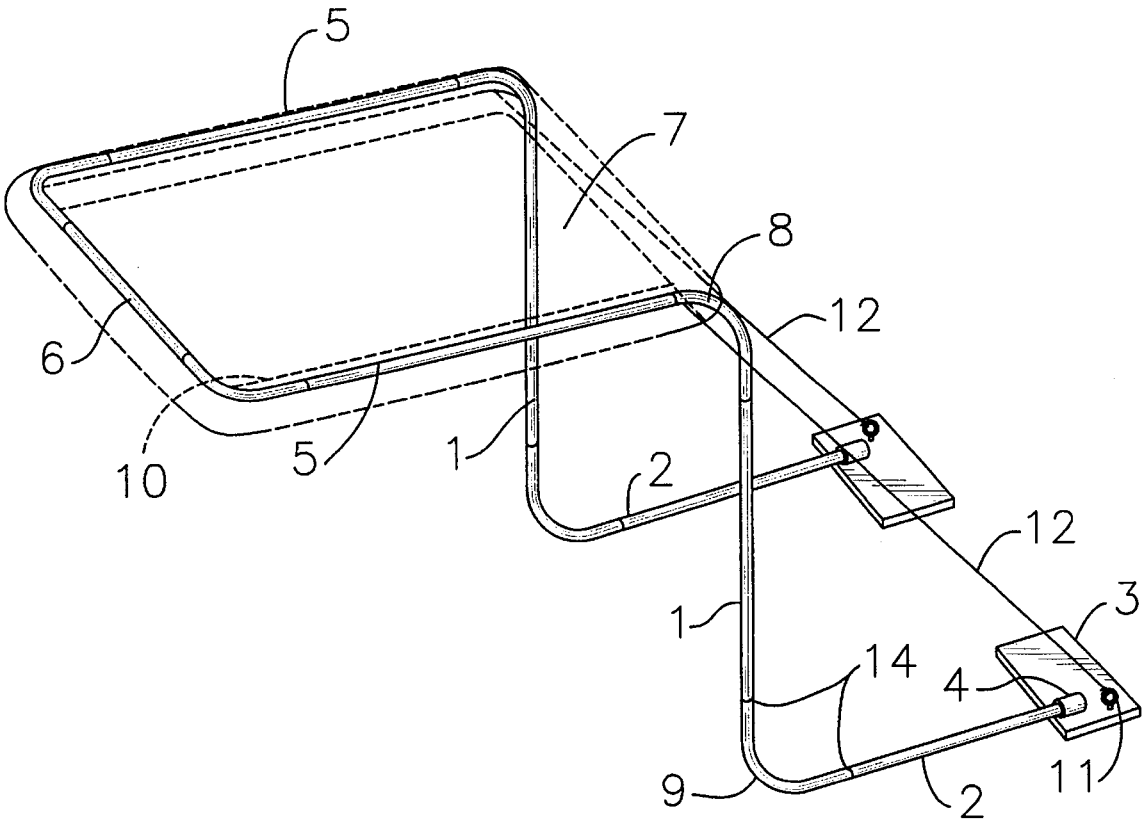
FIG. 1 is perspective elevation showing the supporting structure of the canopy of the present invention with the awning cover shown in phantom.

Directing attention to FIG. 1 of the drawings, a flexible canopy of rectangular configuration is shown in phantom at 7. The material from which this canopy is constructed is not critical and can be for example a plastic fabric or cloth which preferably is waterproof. Although the canopy 7 will be seen to have a generally rectangular configuration, it will also be noted that it has downwardly projecting sides which extend over the horizontal frame members 5 and 6. The method by which the flexible canopy 7 is attached to the frame members 5 and 6 is not especially critical. However, one preferred and convenient manner of doing this is illustrated and consists of a channel 10 sewn about the periphery of the canopy 7 into which the support frame members are inserted. It will be appreciated however that the canopy 7 could also merely fit down over the frame or be attached by tie strings, "velcro" or other means. The flexible canopy 7 is supported by a canopy frame of rectangular configuration consisting of two horizontal members 5 and cross piece 6. As shown, these three members interlock to form a rectangular frame which supports the canopy 7 at its outermost periphery on three sides.

Figure 2:
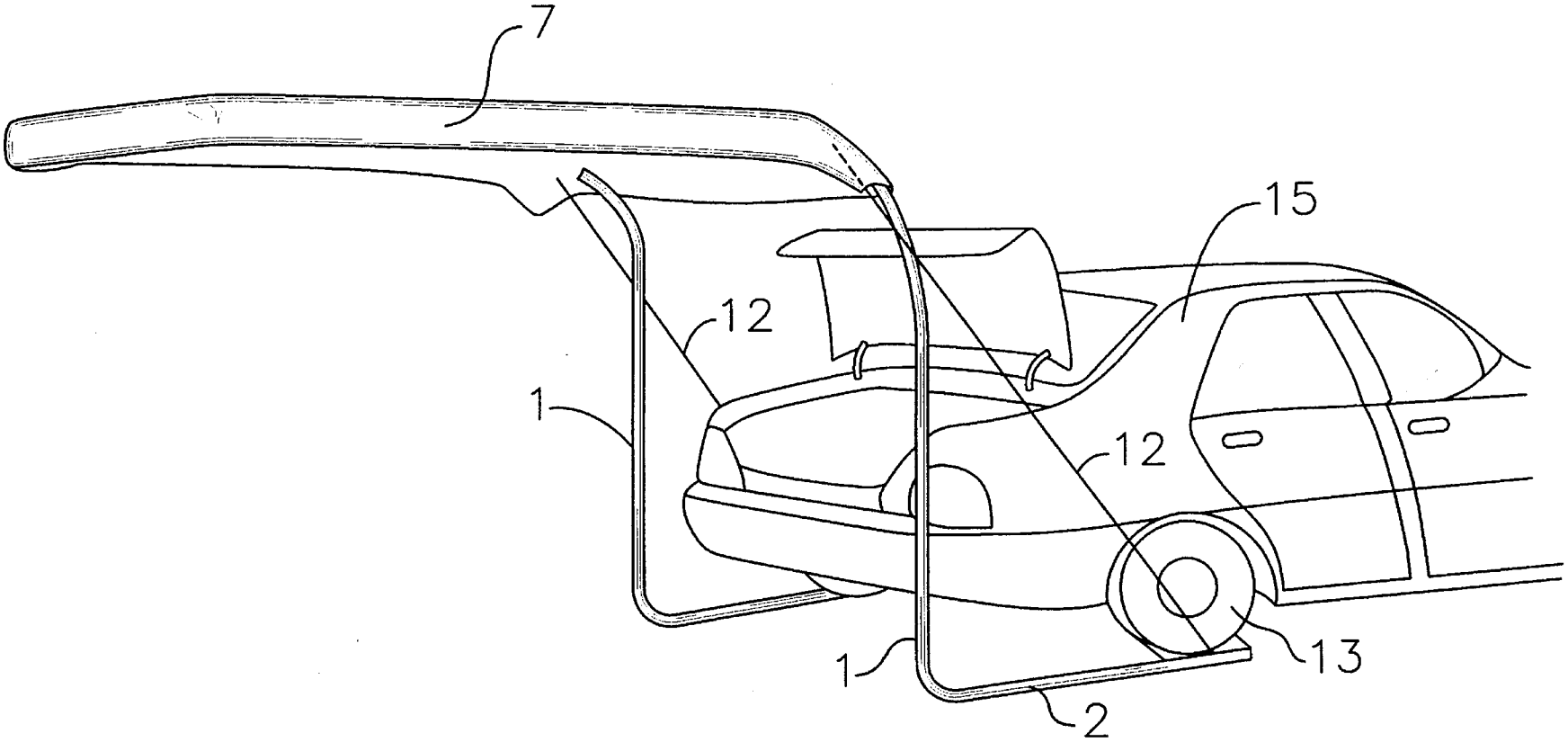
FIG. 2 illustrates the canopy of the present invention in place at the rear of a motor vehicle whose wheels anchor the structure.
Figure 3:
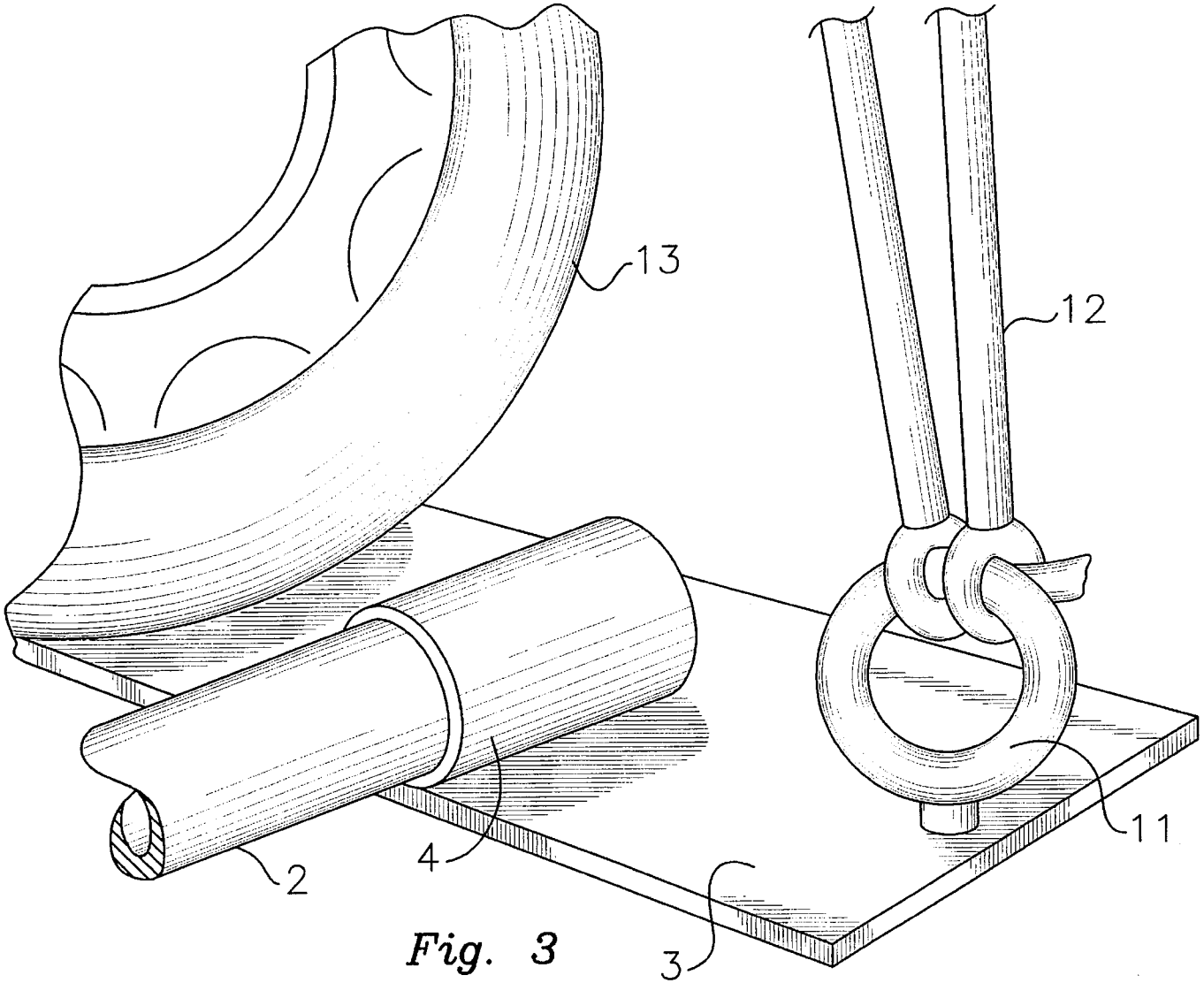
FIG. 3 is a close up view of the anchor plate of the device of the invention illustrating the manner in which the frame is attached to the anchor plate.

When assembled, the entire horizontal 7 structure and its supporting frame 5 & 6 are maintained in horizontal elevated position by an upright support structure consisting of two vertical supports 1 which engage respectively with the two horizontal nembers 5. At their respective lower ends, the two vertical supports 1 each engage one of two parallel horizontal supports 2 which extend backward away from the vertical supports in a direction opposite to that of the canopy 7. The two horizontal support members 2 themselves engage respective fiat anchor plates 3 by sliding within the socket members 4. As further illustrated in the drawing, a pair of ropes or cables 12 are attached to eye bolts 11 on the anchor plate to more firmly secure the flexible canopy 7 to its supporting structure. Directing attention to FIG. 2 of the drawings, it will be seen how the device of the invention is employed in conjunction with the rear of a vehicle. As shown, the rear wheels 13 of vehicle 15 rest firmly on anchor plates 3 to provide necessary counter weight and support to keep the entire awning structure in its desired horizontal position. FIG. 3 of the drawings illustrates in greater detail the structure of the anchor plate and its engagement with the horizontal elongated support member 2. As shown, the plate 3 is provided with a socket 4 having essentially the same internal diameter as the outside diameter of the tubular support 2 such that the support 2 can be slid into the socket 4 in firm engagement. Eye bolt 11 is shown attached to plate 3 to provide an anchoring point for cable 12. It will be understood however that the eye bolt could be replaced with any other convenient sort of attachment device that would permit a flexible cord, rope, or cable 12 to be attached to the anchor plate 3 extended up to the canopy 7.

In order to facilitate disassembly and erection of the structure of the present invention, the support members are constructed of interlocking lightweight or tubular elements which can engage one another by having a male/female socket provision on their ends. It will further be appreciated that it is not critical where the specific junctures between support members occur or how many such junctures are provided except that the disassembled pieces should be of efficiently small dimension that they will easily fit within the trunk or other storage provision of the vehicle. Also, it is desirable if the supporting structural members are not comprised of too many interlocking pieces since this can result in undesirable flexing of the supporting structure. The entire vertical and horizontal supporting structure can be comprised of a series of tubular straight members such as 2,1,5, and 6 illustrated in FIG. 1 of the drawings interconnected by right angle elbows as shown at 8 and 9 into which the straight members fit, for example at 12.

The supporting structure of the invention can also be made of any sufficiently rigid material such an aluminum, steel, plastic or fiber glass. Important considerations in choosing the particular materials will be strength, weight and durability as well as expense.

It will also be appreciated that the canopy of the present invention can be employed in connection with various other accessories such as mosquito netting, additional awnings, or privacy screening. The invention possesses the advantage that it can be assembled quickly and easily without the need for any tools and can be used on any surface onto which a vehicle can be driven. Further, it does not require the use of any stakes which could harm or impair the integrity of the surface on which it is placed.

What is claimed is:

1. A canopy adapted to extend in a horizontal plane from an upright supporting structure, said canopy comprising a flexible planar panel supported on at least three sides by a canopy frame secured to the edges of said panel, said canopy frame comprising a pair of spaced elongated members which extend horizontally in parallel with one another to engage towards their respective distal ends, the ends of a horizontal elongated end cross piece, thereby to form a generally rectangular horizontal canopy frame; the two proximal ends of said horizontally extending elongated members forming said canopy frame engaging at right angle said upright supporting structure which comprises two elongated parallel vertical supports whose upper ends each engage said respective proximal ends of the horizontally extending canopy frame members and whose lower ends each engage one end of respective parallel horizontal elongated supports which extend at right angles away from said vertical supports in the opposite direction to said canopy frame to each engage at its other end a flat horizontal anchor plate having sufficient dimensions to engage firmly between a vehicle tire and underlying surface.

2. The canopy of claim 1 wherein said canopy frame and said upright supporting structure are comprised of interlocking tubular members and supports.

3. The canopy of claim 1 wherein the said other ends of the horizontal elongated supports engage said anchor plates by fitting within the sockets attached thereto.

4. The canopy of claim 2 wherein said interlocking tubular members and supports can be disengaged from one another to disassemble the entire canopy structure.

* * * * *